US007685923B1

(12) United States Patent
Payne et al.

(10) Patent No.: US 7,685,923 B1
(45) Date of Patent: Mar. 30, 2010

(54) FRAGMENT CAPTURE DEVICE

(75) Inventors: Lloyd R. Payne, Los Lunas, NM (US); David L. Cole, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 0 days.

(21) Appl. No.: 12/199,340

(22) Filed: Aug. 27, 2008

(51) Int. Cl.
*F41H 5/013* (2006.01)
*F41H 5/24* (2006.01)

(52) U.S. Cl. ..... 89/36.02

(58) Field of Classification Search ..... 86/50; 89/36.02

See application file for complete search history.

(56) References Cited

U.S. PATENT DOCUMENTS 3,605,362 A * 9/1971 Sweeney ..... 52/223.2
4,263,862 A * 4/1981 Shepherd ..... 114/65 A
5,576,511 A 11/1996 Alhamad
5,864,767 A 1/1999 Drumgoole et al.
6,196,107 B1 3/2001 Hoffman et al.
6,244,155 B1 6/2001 Sparks
6,813,986 B1 11/2004 Tafoya et al.
6,881,383 B1 4/2005 Tschritter et al.
6,938,533 B2 9/2005 Holland et al.
6,991,124 B1 1/2006 Palley et al.

FOREIGN PATENT DOCUMENTS

JP 8-179076 * 7/1996

* cited by examiner

*Primary Examiner*—Stephen M Johnson
(74) *Attorney, Agent, or Firm*—Carol I Ashby

(57) ABSTRACT

A fragment capture device for use in explosive containment. The device comprises an assembly of at least two rows of bars positioned to eliminate line-of-sight trajectories between the generation point of fragments and a surrounding containment vessel or asset. The device comprises an array of at least two rows of bars, wherein each row is staggered with respect to the adjacent row, and wherein a lateral dimension of each bar and a relative position of each bar in combination provides blockage of a straight-line passage of a solid fragment through the adjacent rows of bars, wherein a generation point of the solid fragment is located within a cavity at least partially enclosed by the array of bars.

14 Claims, 6 Drawing Sheets

FRAGMENT CAPTURE DEVICE

The United States Government has rights in this invention pursuant to Department of Energy Contract No. DE-AC04-94AL85000 with Sandia Corporation.

BACKGROUND OF THE INVENTION

This invention relates to a fragment capture or suppression device for use in explosive containment. One of the fundamental issues for fragmenting explosive devices and munitions in containment vessels is the damage that high-speed fragments generated during explosion of the device or munition can cause to the mechanical integrity of the containment vessel. In addition to the structural outer walls of the containment vessel, some vessels comprise an inner lining comprising some type of blast-attenuation means to reduce the impact of blast-generated fragments on the structural outer walls. In some cases, the blast attenuation means is a solid metal liner insert that is placed within the containment vessel. Frequently, such large, heavy fragment-suppression systems are employed on a one-use basis to slow and capture fragments. For containment vessels of considerable size, such a liner can be very heavy and cumbersome to replace when it has exceeded an acceptable level of damage from blast fragments. In some cases, the blast attenuation means can be an inorganic material, such as gravel, or a polymeric material, such as foam. While replacement of the latter materials may be relatively easy, they are not suitable for many applications where issues other than simple fragment capture or suppression are important.

In some cases, the explosive device/munition may contain dangerous chemical, biochemical, or biological agents that must be contained and destroyed within the explosive containment vessel. In such cases, protection of the structural integrity of the containment vessel is especially important to avoid personnel exposure resulting from to vessel puncture or rupture. Additionally, containment devices that must also provide for the safe destruction of the chemical, biochemical, or biological portion of the explosive device tend toward a much higher degree of structural complexity that may not allow easy use of combustible organic materials such as foams or granular materials such as gravel.

BRIEF DESCRIPTION OF THE DRAWINGS

The accompanying drawings, which are incorporated in and form part of the specification, illustrate some embodiments of the present invention and, together with the description, serve to explain the principles of the invention.

DETAILED DESCRIPTION OF THE INVENTION

This invention comprises a fragment capture device suitable for a wide range of explosive/munition containment applications. It is adaptable to a wide variety of containment vessels, including those employed for destruction of devices containing chemical, biochemical, and/or biological agents. In some applications, it may be used independent of a containment vessel. It is an object of this invention to have a modular fragmentation capture device that allows for the easy replacement of only the damaged parts of a containment system rather than of the entire system. The modularity of the fragmentation capture device relaxes constraints on the specific explosive charge configuration or design that can be contained and allows the user to place many types of fragmenting charges inside a system while preventing damage to a surrounding containment vessel or to a valuable nearby asset (material or personnel).

Embodiments of the present invention comprise an assembly of at least two rows of bars positioned to eliminate line-of-sight trajectories between the generation point of fragments and a surrounding containment vessel or asset. For the purpose of this invention, a bar is a relatively long (compared to its longitudinal cross section) solid piece of a material of sufficient to stop a high-velocity solid projectile (fragment) such as emanates from an exploding explosive device. An illustrative drawing of one embodiment is presented in FIG. 1; a cross-sectional view is presented in FIG. 2*a*. Two concentric rows of cylindrical bars (rods) 10 and 12 are held in position by two positioning plates 14 and 16. A cavity 18 is partially enclosed by the array of rods that encircle the cavity space. The rods in the adjacent rows are staggered such that they do not lie on a line extending radially from an origin point or center reference point 22 on an axis located near but not necessarily at the center of the cavity 18. In operation, it is generally desirable to place the explosive device that will produce the fragments at or proximate to the center reference point; in general, the lateral extent of an explosive device will preclude all fragments from originating precisely at the center reference point.

Figure 2A:
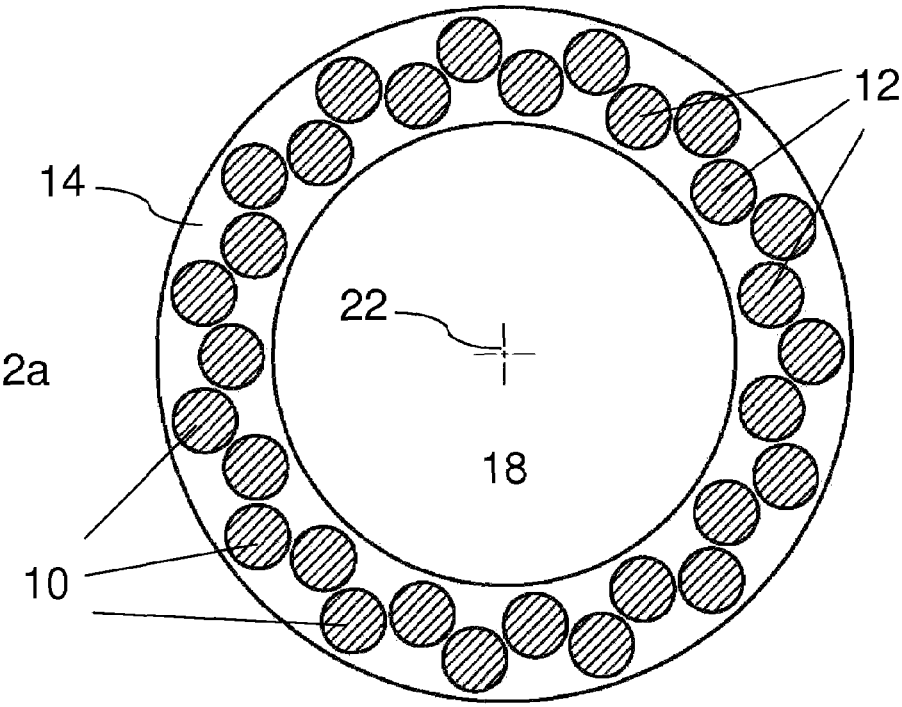
FIG. 2*a* illustrates a cross-sectional view of the embodiment in FIG. 1 showing the arrangement of two rows of circular bars in a positioning plate.
Figure 2B:
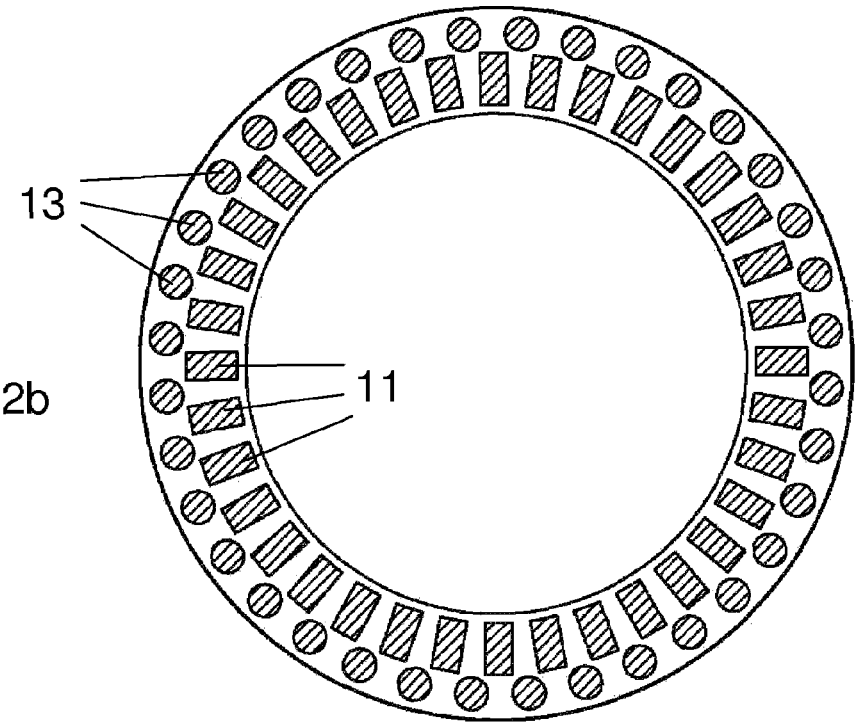
FIG. 2*b* shows an arrangement of bars in a positioning plate where one row of bars has a rectangular cross section and a second row of bars has a circular cross section.

In different embodiments of this invention, the lateral cross sectional shape and lateral dimension of the bars can be varied provided the staggered rows formed with the bars provide blockage of a straight-line passage of a solid fragment through the rows. The cross sectional shape of the bars may be circular, oval, polygonal, or some other shape. An individual bar can have a uniform cross section along the length of the bar, it can be tapered, or it can vary nonmonotonically along the length of the bar. Both the dimensions of the cross section of an individual bar and the shape of the bar may be varied along the length of the bar. The shape or dimension of the plurality of bars within a given row can vary, as can the shape or dimension of the bars in adjacent rows. An embodiment wherein the bars of one row 11 have a rectangular cross section and the bars of a second row 13 have a circular cross section is illustrated in FIG. 2*b*.

In various embodiments, at least some of the bars can be removably threaded through the holes in the positioning plate or plates. This can be especially helpful for the person using the device when the size of the device is such as to make it heavy or difficult to handle. In addition to making it easier to place the device in its intended location of use, the ability to remove bars that have been damaged by fragment impact or for any other reason is an advantage of embodiments of this device. The bars in various embodiments can be made of materials of sufficient mechanical strength to capture fragments. In many embodiments, metal bars can be used. Suitable metals include but are not restricted to iron, iron-based alloys including but not restricted to steels, aluminum, and aluminum alloys.

Figure 3:
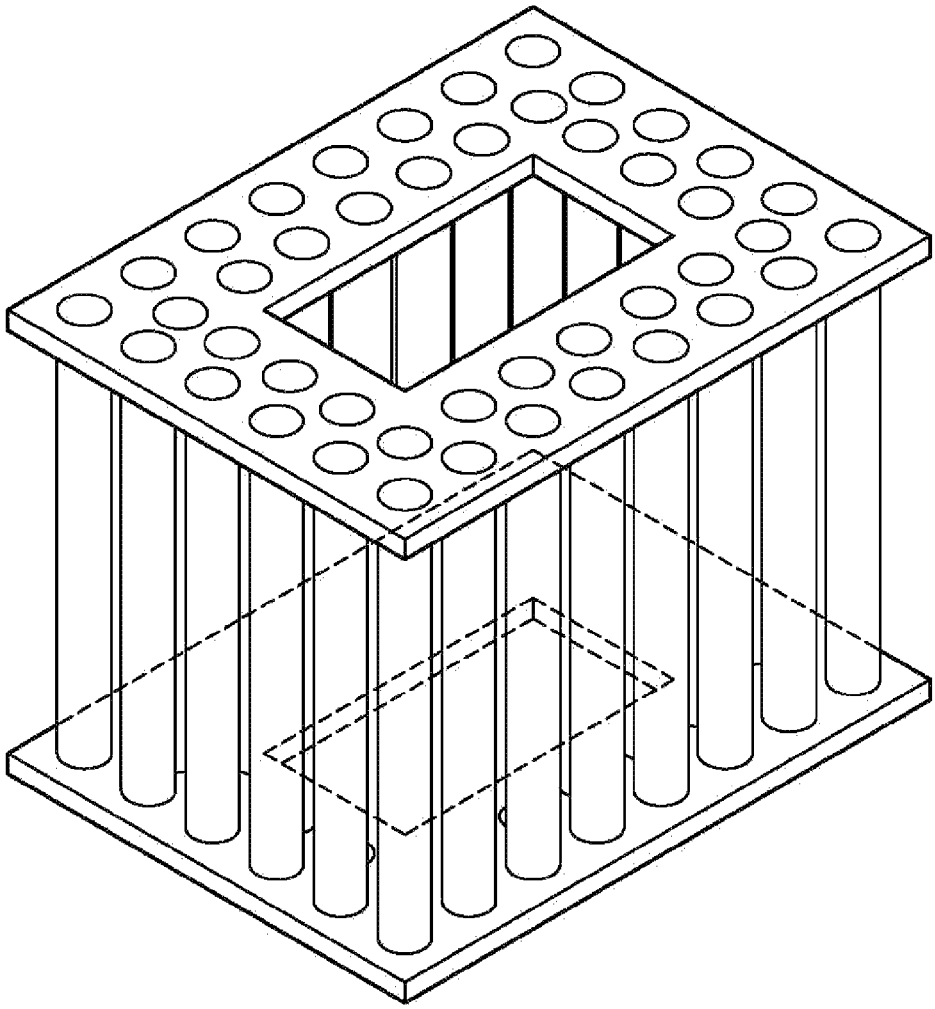
FIG. 3 illustrates an embodiment wherein the two positioning plates hold two concentric rectangular rows of staggered bars.

In various embodiments, the positioning plate can vary in shape provided the holes therein serve to hold the bars in the positions required to establish the two staggered rows. FIG. 3 illustrates an embodiment where the two rows of bars form a rectangular array. In other embodiments, other geometric configurations of the two rows can be used.

Figure 4:
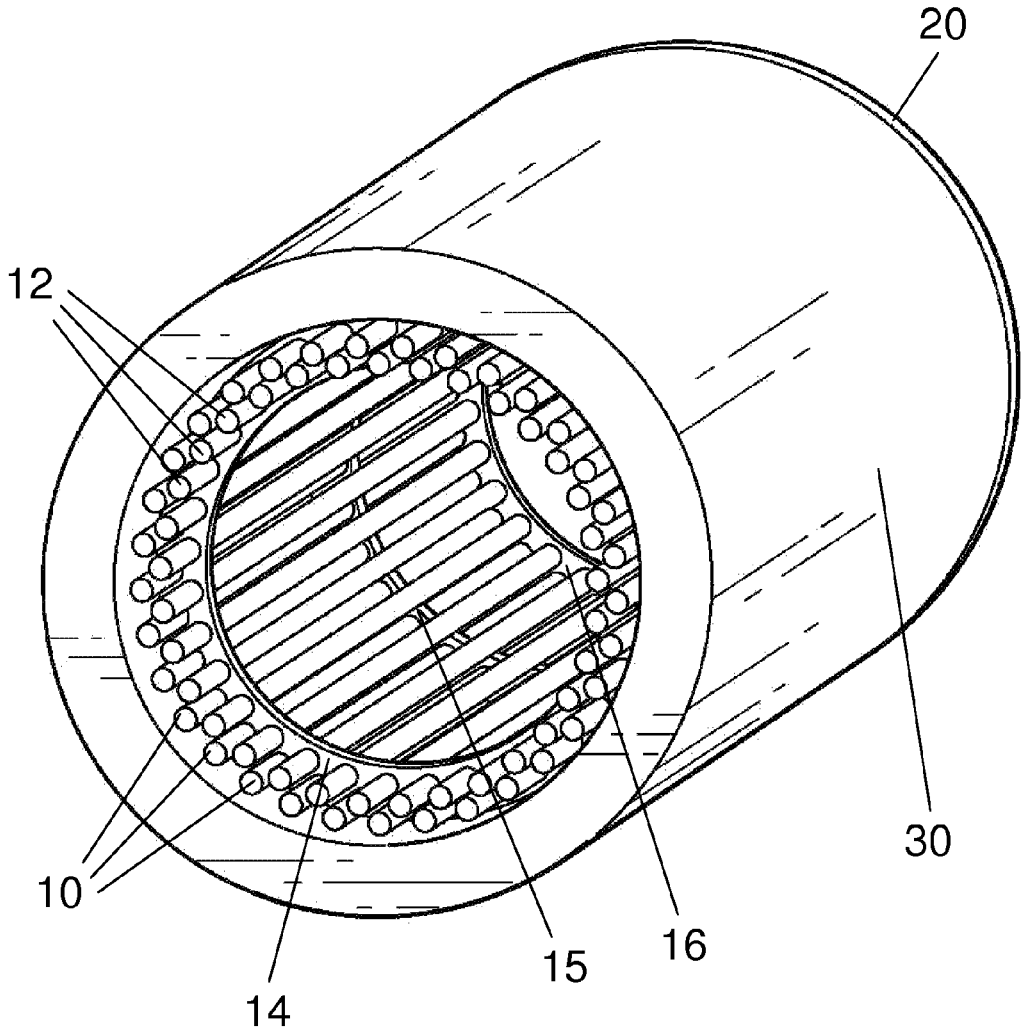
FIG. 4 illustrates an embodiment wherein a positioning plate comprises one row of holes and one row of notches in the edge of the positioning plate for positioning the two rows of bars.

In FIG. 4, an embodiment is illustrated wherein a stabilizing plate 15 comprises one row of holes and a second row of notches along the inner edge of the stabilizing plate for supporting the inner row of bars 12. The notched stabilizing plate provides for stabilization of the bars in the desired position while reducing the weight of the device compared to an embodiment with two rows of holes in the positioning plate.

In some embodiments, the staggered-bar fragment capture device may be contained within an outer casing (30 in FIGS. 1 and 4) that surrounds the array of bars. In some embodiments, one or more of the positioning plates may be affixed to the outer casing. In some embodiments, the casing may be positioned around the positioning plate or plates and the array of bars without being affixed to the positioning plate or plates.

In some embodiments, end caps may be positioned at the top and/or bottom of the array of bars to capture fragments that would otherwise escape confinement. The endcap (20 in FIGS. 1 and 4) can comprise many different forms, including but not limited to a solid plate, a perforated plate, and a plate-like version of the staggered-bar fragment capture assembly. In many embodiments, the solid plate and the perforated plate are made substantially of metal. The end cap can be mechanically affixed to the staggered-bar fragment capture device or in some embodiments may be held in place by gravity. In some embodiments, the endcap may be affixed to or be a portion of an outer casing.

Figure 1:
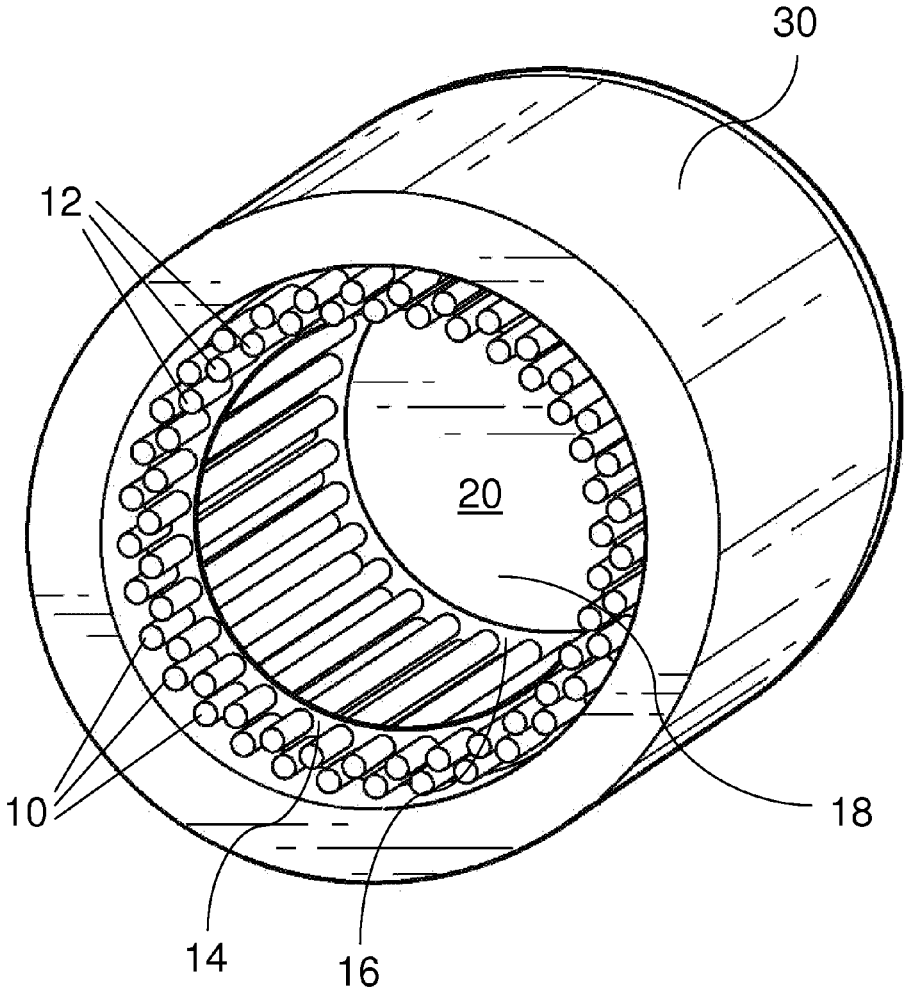
FIG. 1 illustrates an embodiment wherein two positioning plates hold two concentric rings of staggered bars within a containing cylinder. An endcap is shown at one end of the containing cylinder.
Figure 5:
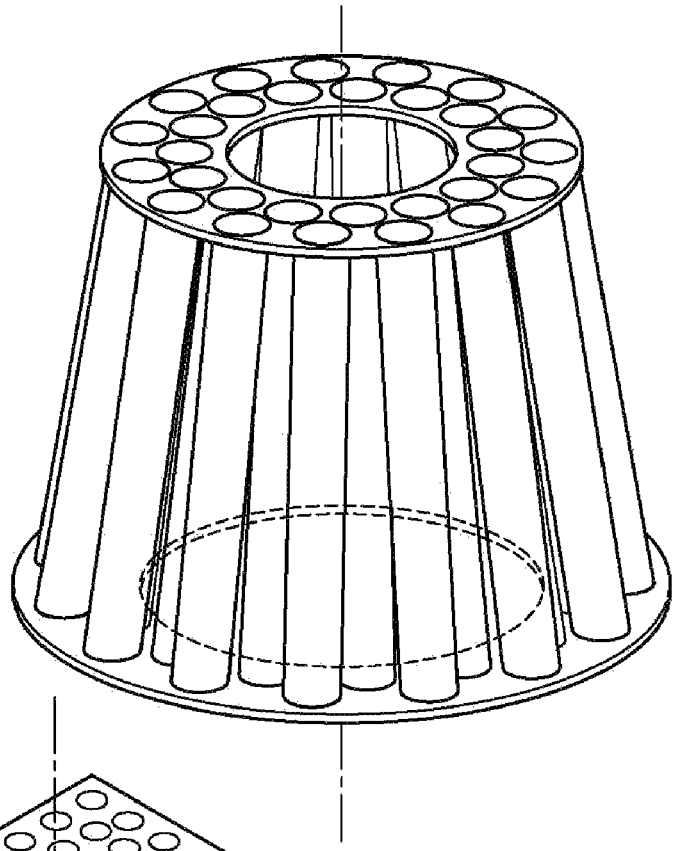
FIG. 5 illustrates an embodiment wherein two circular positioning plates of different diameters hold two concentric circular rows of staggered bars that have their long axes tilted to form a truncated conical cavity.
Figure 6:
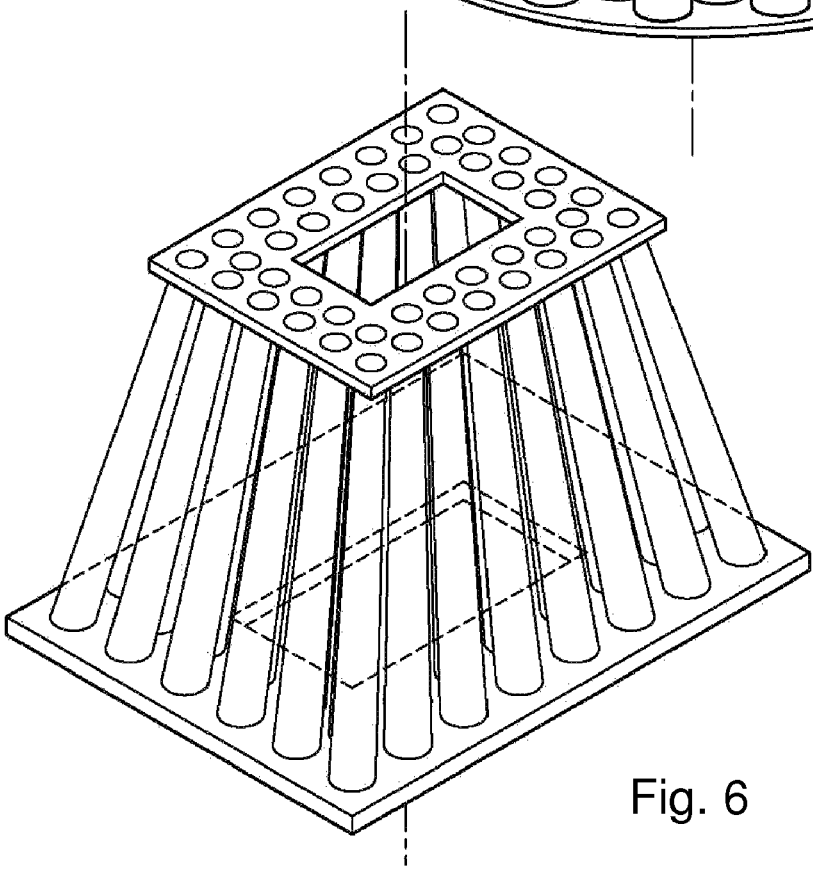
FIG. 6 illustrates an embodiment wherein two rectangular positioning plates with sides of different lengths hold two concentric rectangular rows of staggered bars that have their long axes tilted to form a truncated pyramidal cavity.

In FIGS. 1 and 3, the bars are aligned with their long axes parallel with each other. In other embodiments, the long axes of the bars can be tilted from the parallel configuration. Two such embodiments are illustrates in FIGS. 5 and 6. FIG. 5 illustrates an embodiment wherein two circular positioning plates of different diameters hold two concentric circular rows of staggered bars that have their long axes tilted to form a truncated conical cavity. FIG. 6 illustrates an embodiment wherein two rectangular positioning plates with sides of the same or different lengths hold two concentric rectangular rows of staggered bars that have their long axes tilted to form a truncated pyramidal cavity.

For the purposes of this invention, the statement that two rows are approximately concentric means that the rows share a common center reference point or axis within the cavity. The center reference point may be but need not be at the exact geometric center of the shape defined by the rows. The cavity shape does not have to possess a high degree of symmetry and the center reference point does not need to be located at the geometric center of a cavity with a high degree of symmetry and an axis through the center reference point does not need to pass through the geometric center of the cavity. The geometric shape defined by the base of the rows of bars may be a polygon, a circle, an oval, another substantially curved shape, and a shape combining curves and straight sides. The geometric shape defined by the top of the rows of bars may or may not be the same as that defined by the base. When the defined geometric shape is the same, the base and top shapes may be geometrically congruent or geometrically similar. When congruent, the long axes of the bars are parallel in the vertical direction (long direction of the bars). When similar, the bars may be positioned as an off-normal (tilted) angle where the bars do not remain parallel over most of their length. Examples of the latter include but are not restricted to conical devices, truncated conical devices, pyramidal devices, and truncated pyramidal devices.

The center reference point does not have to be located at exactly the same position within the shape defined by a first positioning plate and the shape defined by a second positioning plate provided the staggered rows block straight-line passage of a solid fragment. When the device is used to capture the fragments generated by an explosive device, the positioning of the explosive device should be such as to place it at or proximate to the center reference point such that the fragments emanating from the explosive device will be intercepted by the array of bars and not have a straight-line passage between the bars to the region outside the bar array. In some applications where the fragments are emanating from an extended array of locations such that they are not traveling out substantially radially from the center reference point, such as, for example, when the explosive device is relatively large compared to the size of the cavity, it may be desirable to have a third staggered row of bars that block the straight-line passage of any fragments that manage to pass between the bars of the first two rows.

In some embodiments where at least two positioning plates are used, one may be a solid plate without a central opening provided an opening in the other plate provides sufficient access for the insertion of the explosive device or munition that is to generate the fragments.

Figure 7:
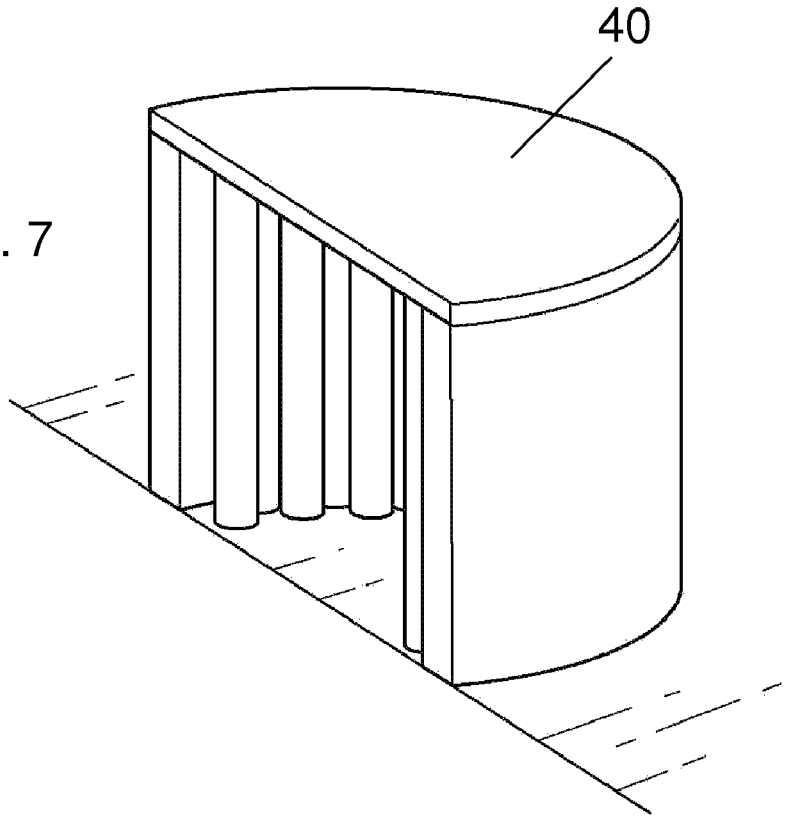
FIG. 7 illustrates an embodiment with a partially open side of the array of staggered bars.
Figure 8:
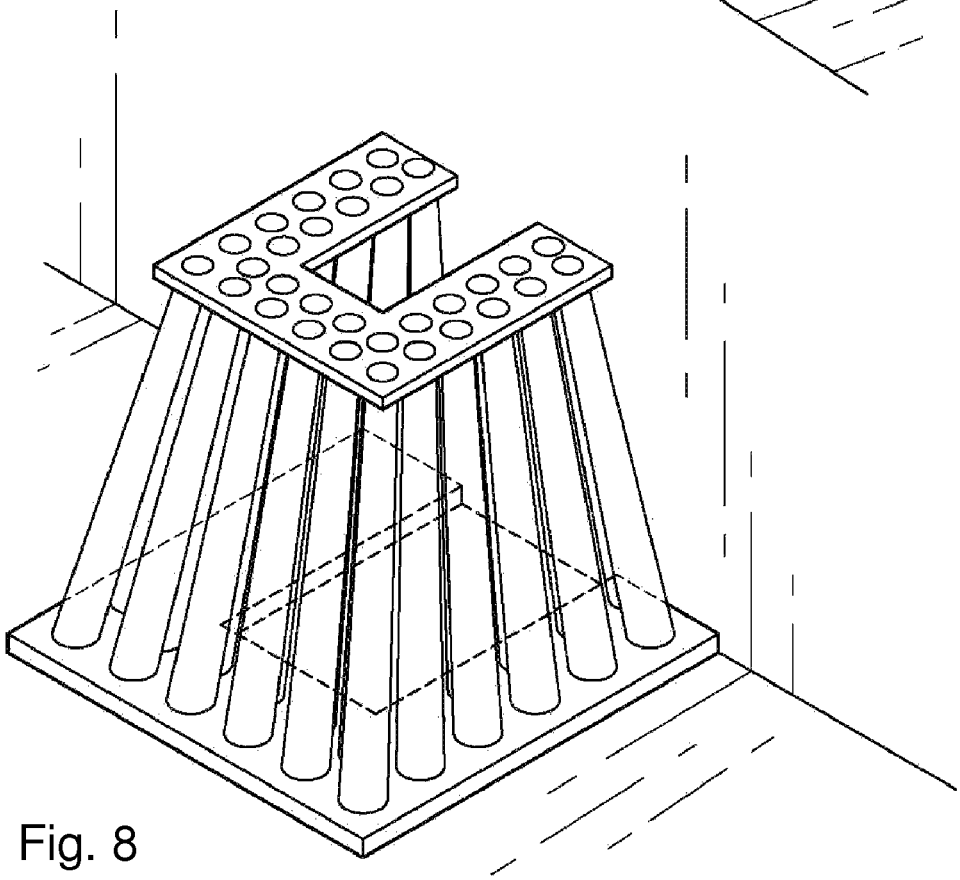
FIG. 8 illustrates another embodiment with one side of the array or bars being open.

In some embodiments, the array of bars may be at least partially open on one side. This allows placement of the fragment capture device around an explosive device that is positioned against a solid surface, such as a wall. It also allows placement around an explosive device where one can then place a solid material, such as metal plate or a plate-like version of the array of staggered bars, across the opening in the fragment capture device to substantially complete the enclosure of the explosive device. FIGS. 7 and 8 illustrate embodiments with an open or partially open side. In the embodiment in FIG. 7, the endcap also serves as the positioning plate with blind holes positioning the rods of the array.

For many applications of embodiments of this invention, two staggered rows of bars are sufficient to block the passage of fragments. In some embodiments, it may be desirable to add one or more extra rows to stop fragments that might be generated in a location within the cavity with a velocity vector that would align with a passage through the two staggered rows of bars.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A staggered-bar fragment capture device, comprising:

an array of bars configured to form at least two adjacent rows of bars, wherein each row is approximately concentric with respect to the adjacent row, wherein each row is staggered with respect to the adjacent row, and wherein a lateral dimension of each bar and a relative position of each bar in combination provides blockage of a straight-line passage of a solid fragment through the at least two adjacent rows of bars, wherein a generation point of the solid fragment is located within a cavity at least partially enclosed by the at least two adjacent rows of bars; and at least one positioning plate comprising holes that hold the array of bars in position.

2. The staggered-bar fragment capture device of claim 1, wherein a lateral cross-section of each bar is selected from the group consisting of a circle, an oval, and a polygon.

3. The staggered-bar fragment capture device of claim 1, wherein the bars are tapered.

4. The staggered-bar fragment capture device of claim 1, wherein the at least two adjacent rows of bars form a fragment barrier around a long axis of the cavity.

5. The staggered-bar fragment capture device of claim 1, further comprising at least two positioning plates comprising holes that hold the array of bars in position.

6. The staggered-bar fragment capture device of claim 5, wherein the positioning plates hold the array of bars so that long axes of the bars are parallel.

7. The staggered-bar fragment capture device of claim 5, wherein the positioning plates hold at least some of the bars nonparallel to a long axis of the cavity.

8. The staggered-bar fragment capture device of claim 1, further comprising a stabilizing plate comprising a row of holes and a row of notches, wherein one row of bars pass through the row of holes and the adjacent row of bars are supported by the row of notches.

9. The staggered-bar fragment capture device of claim 1, wherein the holes of at least one of the positioning plates are blind holes.

10. The staggered-bar fragment capture device of claim 1, further comprising an outer casing at least partially surrounding the array of bars.

11. The staggered-bar fragment capture device of claim 10, wherein the outer casing is affixed to at least one positioning plate.

12. The staggered-bar fragment capture device of claim 10, further comprising at least one endcap.

13. The staggered-bar fragment capture device of claim 12, wherein the endcap is selected from the group consisting of a solid plate, a perforated plate, and a staggered bar array.

14. The staggered-bar fragment capture device of claim 12, wherein an array of blind holes spatially corresponding to the array of bars and holding ends of the bars of the array of bars therein are present in one surface of the endcap.

* * * * *